US010274206B2

(12) United States Patent
Chen

(10) Patent No.: US 10,274,206 B2
(45) Date of Patent: Apr. 30, 2019

(54) EMBEDDED TYPE STEAM GAS STOVE

(71) Applicant: Hangzhou Tuohai Electronics Co., Ltd, Hangzhou (CN)

(72) Inventor: Guozhang Chen, Hangzhou (CN)

(73) Assignee: Hangzhou Tuohai Electronics Co., Ltd., Hangzhou (CN)

( * ) Notice: Subject to any disclaimer, the term of this patent is extended or adjusted under 35 U.S.C. 154(b) by 157 days.

(21) Appl. No.: 15/447,107

(22) Filed: Mar. 1, 2017

(65) Prior Publication Data

US 2017/0356659 A1 Dec. 14, 2017

(30) Foreign Application Priority Data

Jun. 11, 2016 (CN) ..... 2016 1 0401587
Dec. 16, 2016 (CN) ..... 2016 1 1167773

(51) Int. Cl.
*F24C 15/32* (2006.01)
*F24C 1/04* (2006.01)
*F24C 15/10* (2006.01)

(52) U.S. Cl.
CPC ..... *F24C 15/327* (2013.01); *F24C 1/04* (2013.01); *F24C 15/10* (2013.01)

(58) Field of Classification Search
CPC ..... F24C 15/327
USPC ..... 126/369
See application file for complete search history.

(56) References Cited

U.S. PATENT DOCUMENTS 3,320,945 A * 5/1967 Dunkelman ..... A47J 27/04 122/208
4,495,932 A * 1/1985 Bratton ..... F22B 1/287 126/20
5,014,679 A * 5/1991 Childs ..... A47J 27/04 126/21 A
5,636,622 A * 6/1997 Urcelay Amondarain ..... F24C 15/327 126/20
2001/0052852 A1* 12/2001 Kouznetsov ..... F24C 7/087 340/630
2013/0220301 A1* 8/2013 Saksena ..... A47J 27/16 126/377.1

* cited by examiner

*Primary Examiner* — Avinash A Savani
(74) *Attorney, Agent, or Firm* — Wayne & Ken, LLC; Tony Hom

(57) ABSTRACT

The invention relates to cooking kitchenware field, and more specifically, to an embedded type steam gas stove. The embedded type steam gas stove comprises a steam system, a gas system and an embedded type panel for installing the steam system and the gas system; wherein the steam system comprises at least one water pump and one steam generator, and the steam generator is connected with at least one unidirectional connector. The quantities of the steam head and gas head of the embedded type steam gas stove can be chosen and configured based on food preference to meet multiple choices of users and apply in different eating places, thereby guiding people to pursuit more healthy and green lifestyle.

5 Claims, 9 Drawing Sheets

EMBEDDED TYPE STEAM GAS STOVE

CROSS-REFERENCE TO RELATED APPLICATIONS

This application claims priority to Chinese Patent Application No. 201610401587.6 with a filing date of Jun. 11, 2016 and 201611167773.4 with filing date of Dec. 16, 2016. The content of the aforementioned applications, including any intervening amendments thereto, are incorporated herein by reference.

TECHNICAL FIELD

The invention relates to cooking kitchenware field, and more specifically, to an embedded type steam gas stove.

BACKGROUND OF THE PRESENT INVENTION

With people's attention to healthy diet, the adverse effects of the traditional cooking methods such as frying on health has been known, so that healthy cooking methods such as steaming is gradually valued and accepted by people. And the best kitchenware for cooking food, steam stove, is rare in current consumer markets, so the cooking appliance for steaming and boiling should be added in consideration of existing cooking methods, so that people's dietary habit is gradually developed towards the green and healthy direction.

SUMMARY OF PRESENT INVENTION

An embedded type steam gas stove is developed for above reasons.

The invention provides an embedded type steam gas stove, comprising:

at least one independent steam system, at least one independent gas system and an embedded type panel for installing the at least one independent steam system and the at least one independent gas system; the steam system comprises at least one water pump, at least one steam generator, an unidirectional connector, a steam head, a water supply pipe, a steam pipe, an electromagnetic valve and an electric control unit; the steam generator is connected to the unidirectional connector through the water supply pipe; the water pump is connected with the steam generator through the water supply pipe; the electromagnetic valve is provided on the steam pipe; the electromagnetic valve is electrically connected with the electric control unit; the steam head is provided on the embedded type panel and is connected with the unidirectional connector; the gas system comprises a gas supply pipe, a combustion device, a gas head, a control device, an ignition device, a waterproof tray and a furnace frame; the control device is installed on the gas supply pipe; the gas supply pipe is connected with the combustion device; the combustion device is connected with the ignition device; the ignition device is connected with the gas head; the waterproof tray and the furnace frame is provided on the embedded type panel; and the steam system comprises the electric control unit with a remote control module, and the independent gas system of the embedded type steam gas stove is operated by a remote smart terminal wirelessly connecting with the electric control unit or at least one button installed on the embedded type panel.

The embedded type steam gas stove comprises at least one independent steam system, the steam system comprises at least one water pump and one steam generator, and the steam generator is connected to at least one unidirectional connector. A plurality of independent steam systems can be configured based on users' need, and each independent steam system is with a set of operation system. And one independent steam system can be configured, one steam generator is connected to a plurality of unidirectional connectors and combined with the gas system to form a many-headed steam gas stove.

Furtherly, when the water pump and the steam generator of the steam system are connected to a plurality of unidirectional connectors, one electromagnetic valve is provided in front of each unidirectional connector. The water pump of the steam system is with variable flow, the steam generator is with variable power, and the flow of the water pump and the power of the steam generator are different based on the quantity used of the unidirectional connector.

The steam generator is provided with a U-shaped electrical heated tube, and the internal flow channel is designed with twists and turns to extend heated channel, so that the flow is completely vaporized. The internal surface of the steam generator is coated with a high temperature resistant and corrosion resistant material to prevent oxidation of the internal surface of the steam generator during long term high temperature operation, affecting the service life of the steam generator, or causing the steam pipe clogged.

The electric control unit of the steam system comprises a remote control module, so that the remote smart terminal control of the many-headed steam gas stove is realized.

The unidirectional connector is connected to the steam head, and the steam head is connected to the steam kettle.

The gas stove is provided with a gas supply pipe, a combustion device, a control device, an ignition device, a waterproof tray and a furnace frame.

Furtherly, the steam system further comprises a connector expansion and contraction device for controlling the expansion and contraction of the unidirectional connector, and the connector expansion and contraction device is provided with a motor, a transmission system and a valve.

The gas used in the gas stove is natural gas or liquefied petroleum gas.

The embedded type panel is integral, and the panel is provided with a button and a rotary knob; the button and the rotary knob are configured as different numbers in different positions based on control type and numbers of the steam head and gas head to realize manually operation of the embedded type panel.

Compared with existing stoves, the invention has following advantages:

1. The embedded type steam gas stove considers both traditional cooking habits of people and new cooking type of modern healthy food, so that people can gradually transfer fried way to steam cooked way.

2. The appearance of the embedded type steam gas stove is the same with existing stoves, however, existing area of kitchen is not occupied, besides, the embedded type steam gas stove can be used both for electricity and gas.

3. The thermal efficiency of the steam stove reach more than 70%, compared with 50%-55% thermal efficiency of the gas stove, the cooking time can be greatly shortened, and cooked food is more delicious. Besides, only ten seconds are needed from starting the steam stove to releasing steam, and rice cooking and food cooking can be performed at the same time if multilayer steam cookware is used, so that the efficiency is higher.

Compared with existing embedded type double-headed gas stove, the embedded type steam gas stove of the invention has obvious advantages in price, and cloud menu on smart terminal APP can be utilized to guide consumers' healthy diet.

DETAILED DESCRIPTION OF PREFERRED EMBODIMENTS

Figure 1:
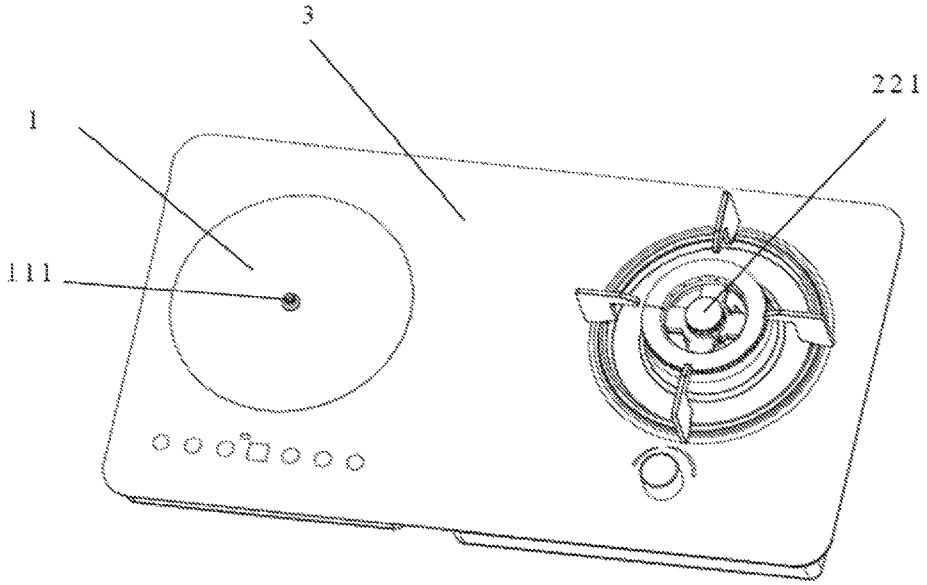
FIG. 1 is an appearance diagram of an embedded type steam gas stove with one steam head and one gas head of the invention.

The technical scheme of the invention is further described in combination with drawings, however, the invention is not limited to this.

As shown in FIG. 1-FIG. 8 an embedded type steam gas stove comprises a steam system 1, a gas system 2 and an embedded type panel 3 for installing the steam system 1 and the gas system 2; the steam system 1 comprises an unidirectional connector 11, a steam head 111, a steam generator 12, a water pump 13, a water supply pipe 14, a steam pipe 15, an electromagnetic valve 16, an electric control unit 17, and a smart terminal 28.

The gas system 2 comprises a gas supply pipe 21, a combustion device 22, a gas head 221, a control device 23, an ignition device 24, a waterproof tray 251 and a furnace frame 252.

Figure 2:
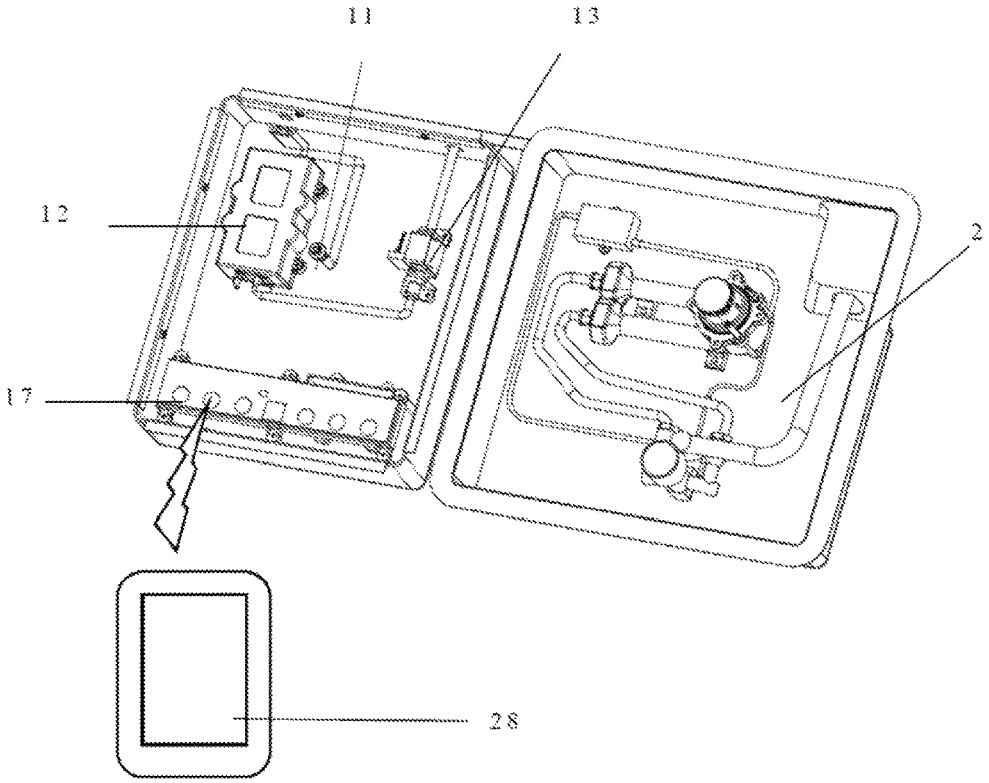
FIG. 2 is an internal structure diagram of an embedded type steam gas stove of one independent steam system with one steam head and one gas system with one gas head.

As shown in FIG. 1 and FIG. 2, the embedded type steam gas stove with one single steam head 111 comprises one steam system 1 and one gas system 2, the steam system 1 comprises one water pump 13 and one steam generator 12, and one steam generator 12 is connected to one unidirectional connector 11, the steam system 1 is provided with an electric control unit 17, and the steam system 1 is combined with the gas system 2 to form an embedded type steam gas stove with one single steam head 111.

Figure 3:
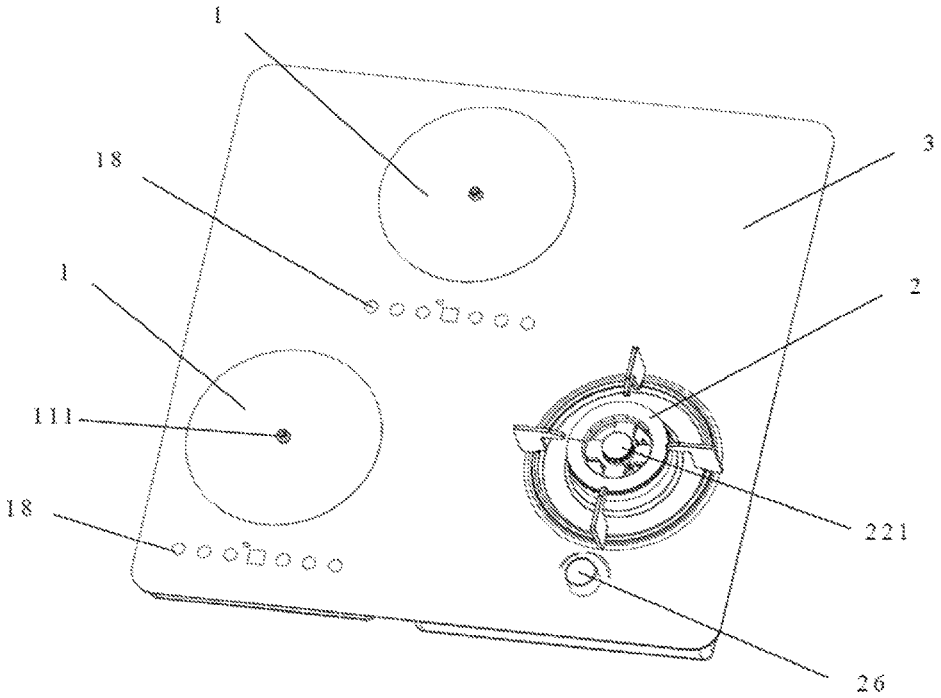
FIG. 3 is an appearance diagram of an embedded type steam gas stove with two steam heads and one gas head of the invention.
Figure 4:
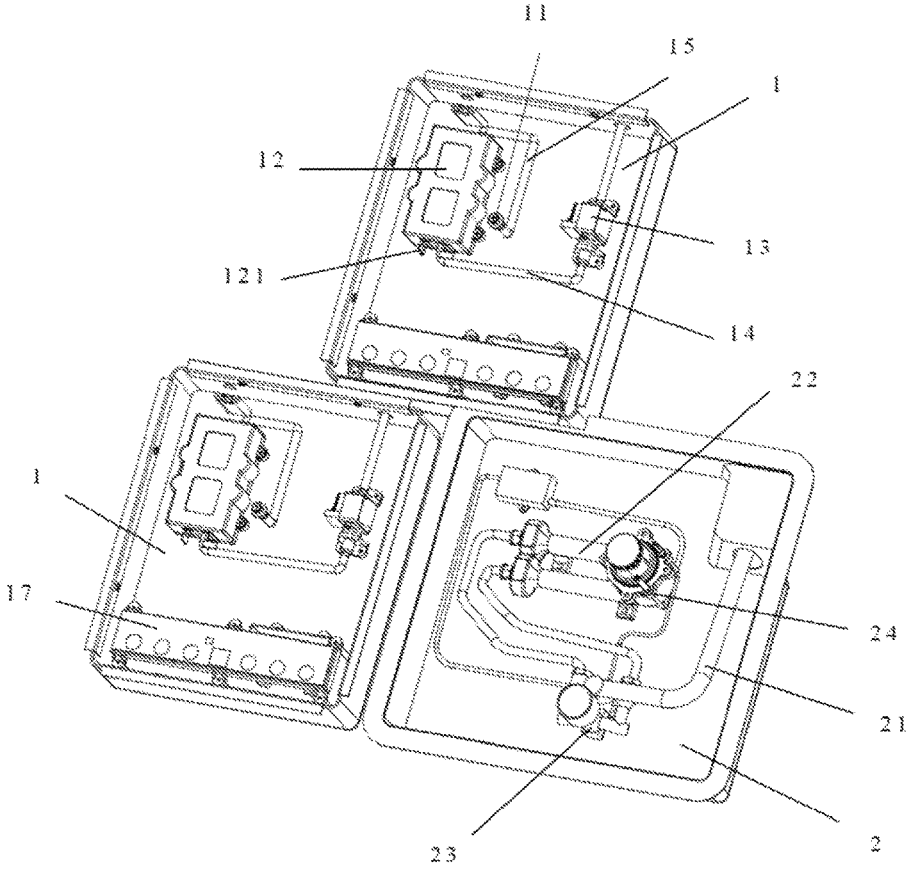
FIG. 4 is an internal structure diagram of an embedded steam gas stove of two independent steam systems with two steam heads and one gas system with one gas steam.

As shown in FIG. 3 and FIG. 4, the embedded type steam gas stove with two steam heads 111 comprises two independent steam systems 1 and one gas system 2, the independent steam systems 1 comprise one water pump 13 and one steam generator 12, one steam generator 12 is connected to one unidirectional connector 11, a plurality of independent steam systems 1 can be configured based on users' need, each independent steam system 1 is provided with one electric control unit 17, and two independent steam systems 1 are combined with the gas system to form an embedded type steam gas stove with two steam heads 111.

Figure 5:
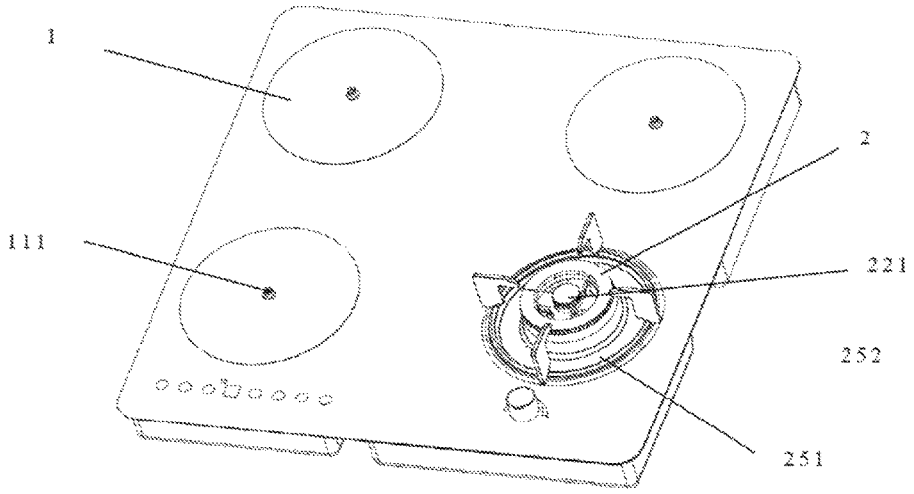
FIG. 5 is an appearance diagram of an embedded type steam gas stove with three steam heads and one gas head of the invention.
Figure 6:
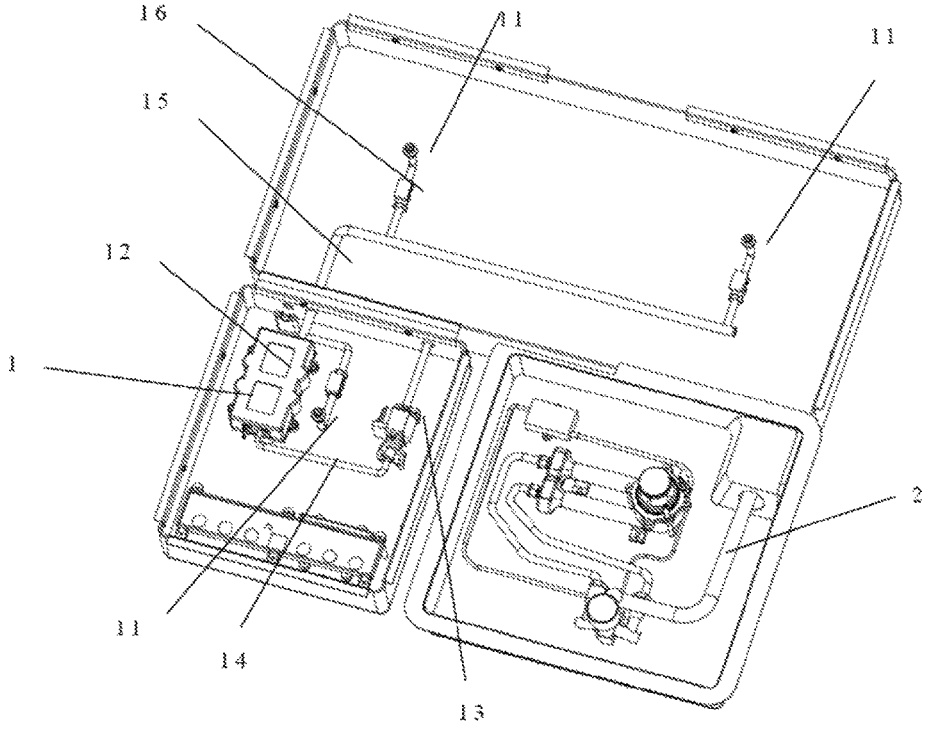
FIG. 6 is an internal structure diagram of an embedded steam gas stove of one steam system with three steam heads and one gas system with one gas head.

As shown in FIG. 5 and FIG. 6, an embedded type steam gas stove with three steam heads 111 comprises one steam system 1 with multiple steam heads 111 and one gas system 2, the steam system 1 with multiple steam heads 111 comprises one water pump 1 and one steam generator 12, and one steam generator 12 is connected to three unidirectional connectors 11 to form many-headed steam gas stove, when one steam generator 12 is connected to multiple unidirectional connectors 11, an electromagnetic valve 16 is provided in front of each unidirectional connector 11. In the steam system 1 with multiple steam heads 111, the water pump 13 is with variable flow, and the steam generator 12 is with variable power, and the flow and power are set by used quantity of the unidirectional connector 11.

Figure 7:
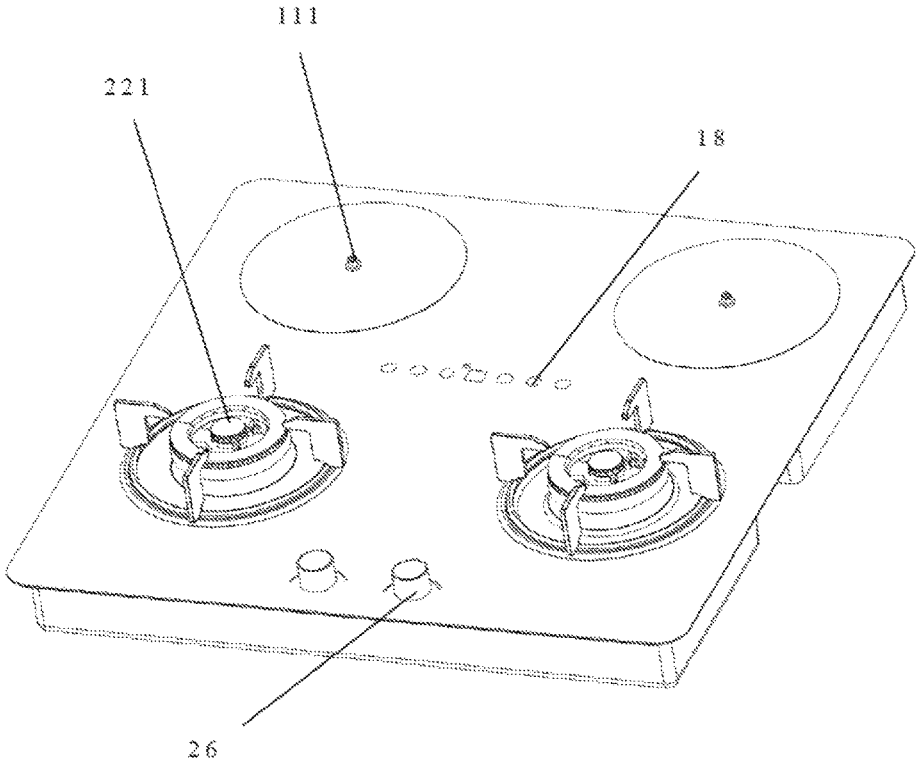
FIG. 7 is an appearance diagram of an embedded type steam gas stove with two steam heads and two gas heads of the invention.
Figure 8:
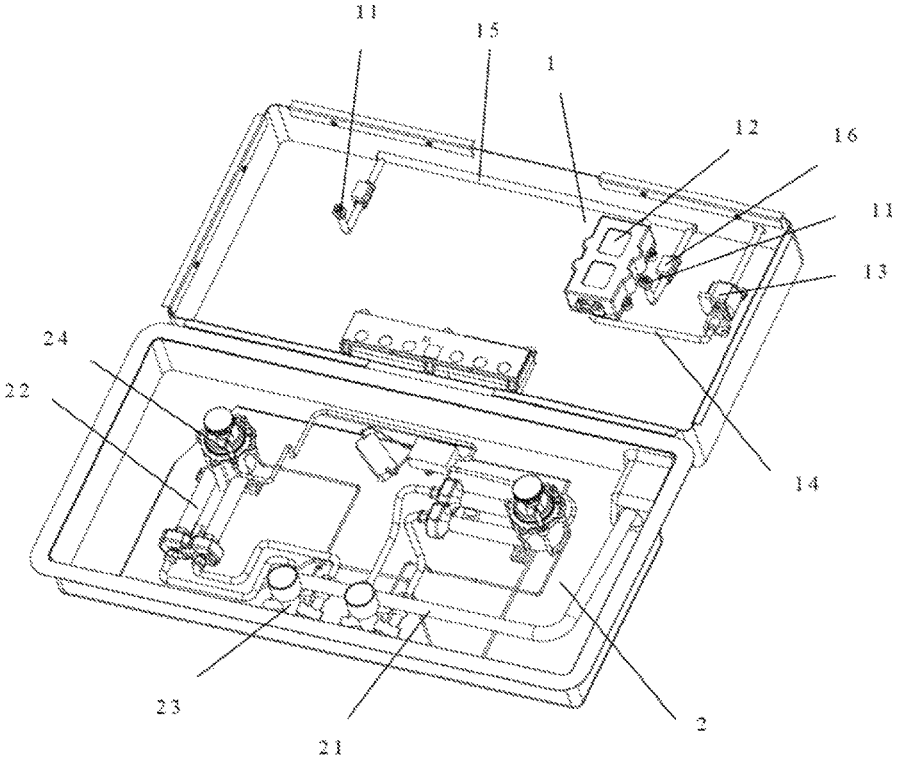
FIG. 8 is an internal structure diagram of an embedded steam gas stove of one steam system with two steam heads and two gas systems with two gas heads.

As shown in FIG. 7 and FIG. 8, an embedded type steam gas stove with two steam heads 111 comprises one steam system 1 with multiple steam heads and two gas systems 2, the steam system 1 with multiple steam heads 111 comprises one water pump 13 and one steam generator 12, and one steam generator 12 is connected to two unidirectional connectors 11.

As shown in FIG. 4, the steam generator 12 is provided with an electrical heated tube 121, and the electrical heated tube 121 is designed with twists and turns to completely vaporize flow. The internal surface of the steam generator is coated with a high temperature resistant and corrosion resistant material to prevent oxidation of the internal surface of the steam generator 12 during long term high temperature operation, affecting the service life of the steam generator 12, or causing the steam pipe 15 clogged.

As shown in FIG. 2, the electric control unit 17 of the steam system 1 comprises remote control module to realize remote smart terminal control of many-headed steam gas stove.

As shown in FIG. 1 and FIG. 2, the unidirectional connector 11 is connected to the steam kettle.

The gas used in the gas stove is natural gas or liquefied petroleum gas.

As shown in FIG. 3, the embedded type panel 3 is integral, and the panel is provided with a button 18 and a rotary knob 26; the button 18 and the rotary knob 26 are configured as different numbers in different positions based on control type and quantity of the steam head 111 and gas head 221 to realize manually operation of the embedded type panel.

Figure 9:
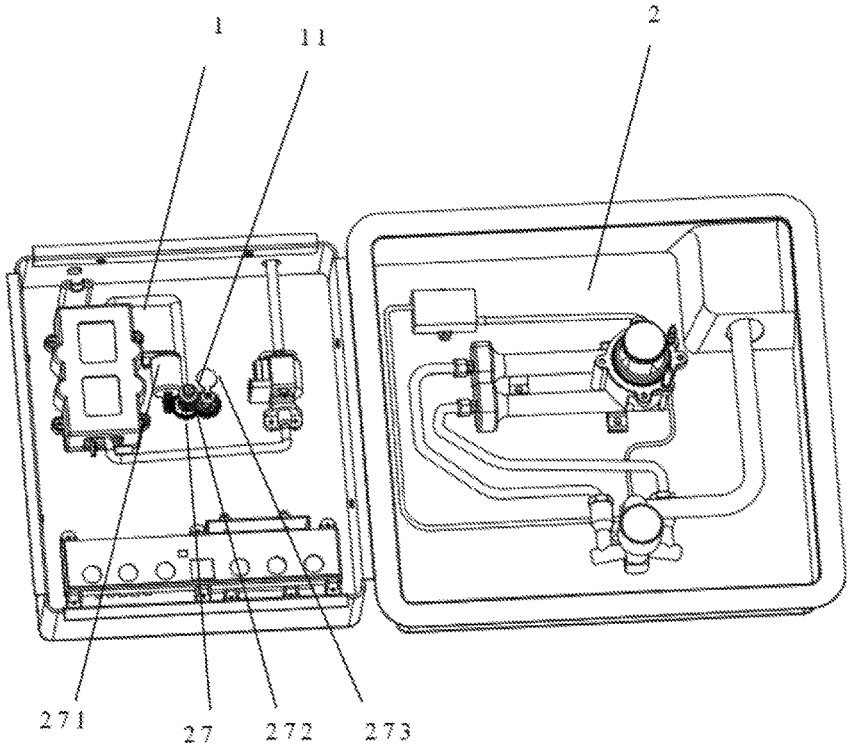
FIG. 9 is a structural diagram of a connector extension and contraction device for controlling the extension and contraction of the unidirectional connector installed in the steam system.

As shown in FIG. 1 and FIG. 9, the steam system 1 further comprises a connector expansion and contraction device 27 for controlling the expansion and contraction of the unidirectional connector 11, and the connector expansion and contraction device 27 is provided with a motor 271, a transmission system 272 and a valve 273. The unidirectional connector 11 installed in the steam system 1 has two conditions, the first condition is when the power of the steam system 1 is on, the unidirectional connector 11 extends out of the embedded type panel 3 driven by the motor 271 and the transmission system 272 installed in the connector extension and contraction device 27, so that the unidirectional connector 11 is connected to the steam head 111. The second condition is when the steam system 1 is off, the unidirectional connector 11 is back to the embedded type panel 3 driven by the motor 271 and the transmission system 272 installed in the connector extension and contraction device, and the valve 273 installed in the connector extension and contraction device 27 is closed. In this way, oil contamination can be prevented into the unidirectional connector 11 when the gas stove 2 is in use, and the cleaning of the embedded type steam gas stove is kept.

Above embodiments are merely for further describing the embedded steam gas stove of the invention, any variations and replacements made by those skilled in the art within the scope of the technical scheme shall be included in the protection scope of the invention.

I claim:

1. An embedded type steam gas stove, comprising:

at least one independent steam system, at least one independent gas system, and an embedded type panel for installing the at least one independent steam system and the at least one independent gas system; wherein the at least one independent steam system comprises at least one water pump, at least one steam generator, at least one unidirectional connector, at least one steam head, a water supply pipe, a steam pipe, at least one electromagnetic valve and an electric control unit;

the at least one steam generator is connected to the at least one unidirectional connector through the water supply pipe; the at least one water pump is connected with the at least one steam generator through the water supply pipe; the at least one electromagnetic valve is provided on the steam pipe; the at least one electromagnetic valve is electrically connected with the electric control unit; the at least one steam head is provided on the embedded type panel and is connected with the at least one unidirectional connector;

the at least one independent gas system comprises a gas supply pipe, a combustion device, a gas head, a control device, an ignition device, a waterproof tray and a furnace frame; the control device is installed on the gas supply pipe; the gas supply pipe is connected with the combustion device; the combustion device is connected with the ignition device; the ignition device is connected with the gas head; the waterproof tray and the furnace frame is provided on the embedded type panel;

the electric control unit comprises a remote control module and the at least one independent gas system of the embedded type steam gas stove is operated by a remote smart terminal wirelessly connecting with the electric control unit or at least one button installed on the embedded type panel;

wherein the at least one steam generator is provided with an electrical heated tube, and the electrical heated tube is designed with twists and turns to completely vaporize flow.

2. The stove according to claim 1, wherein when the steam system controls a plurality of unidirectional connectors, the steam system comprises the water pump with variable flow and the steam generator with variable power.

3. The stove according to claim 1, wherein an internal surface of the steam generator is coated with a high temperature resistant and corrosion resistant material.

4. The stove according to claim 1, wherein the embedded type panel is integral, and the panel is provided with a button and a rotary knob; the button and the rotary knob are configured as different numbers in different positions based on control type of the steam system and gas system and numbers of the steam head and gas head.

5. The stove according to claim 1, wherein the steam system further comprises a connector expansion and contraction device for controlling the expansion and contraction of the unidirectional connector, and the connector expansion and contraction device is provided with a motor, a transmission system and a valve.

* * * * *